US006938757B2

(12) United States Patent
Eastman et al.

(10) Patent No.: US 6,938,757 B2
(45) Date of Patent: Sep. 6, 2005

(54) TAMPER EVIDENT CLOSURE

(75) Inventors: Harold Eastman, Hampshire (GB); Eric Fredolin Ahlquist, Somerset (GB); Dudley Keith Webb, Somerset (GB)

(73) Assignee: Allied Domecq Spirits & Wine Limited, Bristol (GB)

( * ) Notice: Subject to any disclaimer, the term of this patent is extended or adjusted under 35 U.S.C. 154(b) by 130 days.

(21) Appl. No.: 10/137,743

(22) Filed: May 2, 2002

(65) Prior Publication Data

US 2002/0195413 A1 Dec. 26, 2002

(30) Foreign Application Priority Data

May 3, 2001 (EP) ..... 01304056

(51) Int. Cl.[7] ..... B65D 25/08; B65D 85/00

(52) U.S. Cl. ..... 206/219; 206/222; 206/459.1; 206/534

(58) Field of Search ..... 206/219, 221, 206/222, 459.1, 532, 534, 807; 215/230

(56) References Cited

U.S. PATENT DOCUMENTS

| | | | | |
|---|---|---|---|---|
| 3,779,372 A | * | 12/1973 | de Lloret | 206/222 |
| 4,424,911 A | | 1/1984 | Resnick | 215/250 |
| 4,432,462 A | * | 2/1984 | Newkirk | 215/365 |

(Continued)

FOREIGN PATENT DOCUMENTS

| | | | |
|---|---|---|---|
| EP | 0 257 835 A1 | 3/1988 | B65D/55/02 |
| EP | 0 279 574 A1 | 8/1988 | G01N/33/52 |
| EP | 0 303 400 A2 | 2/1989 | B65D/55/02 |
| EP | 0 352 962 A1 | 1/1990 | B65D/41/34 |
| EP | 0 443 750 A1 | 8/1991 | B65D/55/06 |
| EP | 2 243 825 A | 11/1991 | B65D/55/06 |
| EP | 0 625 467 A1 | 11/1994 | B65D/55/06 |
| EP | 0 629 497 A2 | 12/1994 | B32B/3/12 |
| EP | 2 283 735 A2 | 5/1995 | B65D/55/02 |
| EP | 2 296 912 A | 7/1996 | B65D/55/06 |
| EP | 2 299 544 A | 10/1996 | G09F/3/02 |
| EP | 0 753 461 A1 | 1/1997 | B65D/27/30 |
| WO | WO 99/24329 | 5/1999 | B65D/55/02 |
| WO | WO 99/28205 | 6/1999 | B65D/41/34 |

OTHER PUBLICATIONS

US 4,448,317, 5/1984, Thompson (withdrawn)
PCT International Search Report, PJF01149WO.

*Primary Examiner*—Jila M. Mohandesi
(74) *Attorney, Agent, or Firm*—Bromberg & Sunstein LLP

(57) ABSTRACT

A tamper evident closure (1) includes a housing (5) containing a blister pack (2) and a substrate (3), wherein the blister pack (2) contains a first reagent which is visible prior to first opening and the substrate (3) contains a second reagent. First opening of the closure ruptures the blister pack thereby exposing the first reagent to the second reagent and effecting a reaction that causes a visual change that signals the closure has been opened. The tamper evident closure of the present invention is primarily intended to be used as an anti-counterfeit measure on a spirit or pharmaceutical bottle. In the preferred embodiment, the closure incorporates a liquid that when brought into contact with a reagent chemical contained in an absorbent pad, effects an irreversible color change. This color change will indicate to a consumer the bottle has been previously opened or tampered with. The design makes it very difficult for a counterfeiter to cover up or eradicate the visible effects. In particular, the only way a counterfeiter could do this would be to put in a replacement blister and an absorbent pad. Filling a blister pack with a liquid is a highly specialist task which makes replication very difficult. The ability to control the color change to complement the branded goods provides a way of building up consumer recognition of the product and thereby establishing confidence in those products that carry the tamper evident closure of the present invention.

31 Claims, 3 Drawing Sheets

U.S. PATENT DOCUMENTS

| | | | | | |
|---|---|---|---|---|---|
| 4,511,052 | A | | 4/1985 | Klein et al. | 215/230 |
| 4,516,679 | A | | 5/1985 | Simpson et al. | 206/459 |
| 4,685,579 | A | | 8/1987 | Stapleton | 215/230 |
| 4,785,931 | A | * | 11/1988 | Weir et al. | 206/222 |
| 4,965,047 | A | * | 10/1990 | Hammond | 422/58 |
| 4,986,429 | A | | 1/1991 | Singleton, Jr. | 215/230 |
| 5,265,744 | A | | 11/1993 | Duty et al. | 215/220 |
| 5,581,978 | A | * | 12/1996 | Hekal et al. | 53/411 |
| 5,617,812 | A | | 4/1997 | Balderson et al. | 116/206 |
| 5,798,169 | A | * | 8/1998 | Smith | 428/212 |
| 6,159,747 | A | * | 12/2000 | Harttig et al. | 436/518 |
| 6,609,612 | B2 | * | 8/2003 | Vlodek | 206/222 |

* cited by examiner

TAMPER EVIDENT CLOSURE

The present application claims priority under 35 U.S.C. §119(a) on the basis of European Application No. 01304056.3, filed May 3, 2001, which application is incorporated herein by reference in its entirety.

FIELD OF THE INVENTION

The present invention relates to a tamper evident closure for a container, and in particular, a closure that acts as an effective anti-counterfeit measure.

BACKGROUND TO THE INVENTION

It is not uncommon for containers for high value branded goods such as spirits to be reused by criminals whereby empty bottles are collected and recycled. Bottles are refilled with a local product that is inferior to the original product and then the package is resealed for resale.

An obstacle that must be overcome by the counterfeiter is the resealing of the bottle closure in a manner such that is virtually impossible for the consumer to determine that the bottle has already been opened. Various tamper evident anti-counterfeit measures have been used in the past in an effort to thwart these criminals. However, in recent times the level of sophistication of the counterfeiters has risen to a point where these measures are no longer effective for one reason or another.

The risk to the consumer is that the counterfeit goods may be in some way harmful. In the case of pharmaceuticals, the counterfeit goods may be wholly ineffective or worse, life threatening. The damage done to the brand owner's business through loss of goodwill or exposure to legal proceedings is also of serious commercial concern.

An important issue to be considered when designing a tamper evident closure is that it must not have a negative impact on the brand and it must have no adverse affect on the product or the consumer.

SUMMARY OF THE INVENTION

According to a first aspect of the present invention, a tamper evident closure comprises a housing containing a blister pack and a substrate, wherein the blister pack contains a first reagent which is visible prior to first opening and the substrate contains a second reagent, and wherein first opening of the closure ruptures the blister pack thereby exposing the first reagent to the second reagent and effecting a reaction that causes a visual change that signals the closure has been opened.

According to a second aspect of the present invention, there is provided a blister pack containing an oil entrained with a first reagent, capable of causing a visual change upon reaction with a second reagent.

The approach taken in the present invention is to provide a tamper evident closure that provides a visual signal to indicate that the closure has been opened. Preferably, the visual change is irreversible.

The blister pack is of a conventional structure such as a piece of thermoformed material bonded to a substantially flat material to form a closure. Preferably, the blister pack comprises one or more enclosures, adapted to retain fluid when sealed. More preferably, the blister pack contains a single enclosure.

Preferably, the blister pack has a membrane which is ruptured on opening of the closure. Blister technology is difficult to replicate by most counterfeiters. Not only is the technology not widely available, a blister pack is also very difficult to refill and reseal once it has been ruptured. The use of a blister pack is therefore an effective way of adding complexity to the closure design to make replication even more difficult for the counterfeiter.

Preferably, the blister pack is at least partially visible prior to first opening. This allows a user to see the visual change caused upon reaction of the first and second reagents.

The blister pack is preferably formed from a suitable material capable of long term retention of fluid contents and, in particular, oil based fluid contents. The blister pack is preferably substantially transparent to visible light. Preferably, the blister pack is formed from a plastics material selected from the group consisting of nylon, polytetrafluoroethylene, acrylate polymers, polyvinylchloride, polyurethane, polycarbonate, polyolefins, silicone plastics, and derivatives, copolymers and mixtures thereof.

The blister pack may be formed from or may comprise additional components such as ultra-violet filters, materials which block the transport of fluids across the surface of the material, plasticizers and the like. In particular, oxygen barrier materials are preferably incorporated in the sealed enclosure, such as polyethylene terephthalate (PET) and ethylene vinyl alcohol (EVOH). These prevent oxygen from penetrating the package. Water barrier materials are also particularly preferred. Preferably, the blister pack substantially prevents the loss or ingress of water from or to the enclosure.

Preferably, the first reagent is a fluid or is dissolved, dispersed or suspended in a fluid carrier. Most preferably the first reagent is dissolved to form a stable solution in a carrier liquid.

A particular problem associated with the prior art is the longevity (shelf life) of the closure. Aqueous solutions and reagents are notoriously difficult to retain within blister packs and like enclosures. Water is known to bleed out of such enclosures and thereby decreases the shelf life of the reagents in the enclosure. Thus, in a preferred embodiment, the carrier liquid is an oil, preferably a mineral or synthetic oil or mixtures thereof. The liquid should have a viscosity such that the liquid is capable of flowing out of a rupture in the blister pack under its own weight at ambient temperature and pressure.

Preferred oils are selected from the group consisting of silicone (including fluorinated silicone), petroleum, glycol, ester and fluorocarbon (including perfluorocarbon). In particular, silicone and paraffin oils are preferred.

Preferably, the carrier fluid has a kinematic viscosity in the range of 0.000001 $m^2/s$ to 0.0001 $m^2/s$, more preferably 0.00001 $m^2/s$ to 0.00003 $m^2/s$, most preferably about 0.00002 $m^2/s$.

The carrier liquid may additionally comprise materials such as anti-oxidants, ultra-violet filters, stabilisers, solvents and the like.

Preferably, the closure comprises a substrate that carries the second reagent. Preferably, the substrate comprises a support, preferably an absorbent pad. Preferably, the absorbent pad offers a degree of rigidity but remains compressible, and should preferably be able to absorb and disperse a fluid substantially throughout its structure.

The support is preferably formed from fibrous materials selected from cellulose fibres, polyacrylonitrile fibres, polyamide fibres, carbon fibre and mineral fibres. In a preferred embodiment, the absorbent pad is manufactured from cellulose fibres.

Preferably, the substrate is pre-treated with the second reagent. The substrate may be impregnated or coated with the second reagent. In a particularly preferred embodiment, the support is spray coated with a solution second reagent. This provides a uniform coating, and thus optimises the reaction between the first and second reagent, which leads to a more uniform color change.

In a particularly preferred embodiment, a surface of the support is provided with a latent printed image that is developed upon exposure to the fluid. For example, the latent printed image may be a photographic image provided on an emulsion plate.

Preferably, the substrate undergoes a visible change, more preferably a color change in response to exposure to the first reagent. Of course, any visible change may be selected to complement the brand associated with the product that the tamper evident closure is to be used with. Preferably, the substrate is visible through the blister pack such that as the first reagent, which is in itself visible prior to first opening, comes into contact with the substrate, the visible change takes place on the support, which is also visible on or after first opening of the closure.

The first and second reagents form a visual change due to reaction of their components. The reaction may be an acid/base reaction, a redox reaction, a precipitation reaction, a complex-formation reaction or a hydration reaction or other types of chemical or other organic compound reactions.

For example, where the reaction is an acid/base reaction, the fluid may be acidic or basic and the indicating means may comprise a pH indicator which visibly changes on acidification or alkalisation respectively.

Where a redox reaction is utilised, the fluid may contain a compound which is oxidised or reduced upon exposure to the indicating means, or causes oxidation or reduction of the indicating means, either of which lead to a visible change.

Where a precipitation reaction is utilised, the reaction of the fluid with the indicating means causes the precipitation of a visibly contrasting material at the surface of the indicating means.

Where a complex-formation reaction is utilised, a visible change may be effected in the indicating means by the formation of a metal-indicator complex from a metal ion solution and a complexing agent.

Where a hydration reaction is utilised, the indicating means may comprise an anhydrous salt which undergoes a visible change upon exposure to an aqueous solution.

Most preferably, an acid/base reaction is used. Preferably, the first reagent is a pH indicator and is selected from those commonly used. Some preferred indicators are tabulated below in table 1. This shows some physical characteristics of the indicators, in aqueous solution, at 25° C. Particularly preferred indicators are bromocresol green, methol red and phenolphthalein.

TABLE 1

| Indicator | pH range | pKa | Acid Form | Base Form |
|---|---|---|---|---|
| Methyl violet | 0.0–1.6 | 0.8 | Yellow | Blue |
| Thymol blue | 1.2–2.8 | 1.6 | Red | Yellow |
| Methyl yellow | 2.9–4.0 | 3.3 | Red | Yellow |
| Methyl orange | 3.1–4.4 | 4.2 | Red | Yellow |

TABLE 1-continued

| Indicator | pH range | pKa | Acid Form | Base Form |
|---|---|---|---|---|
| Bromocresol green | 3.8–5.4 | 4.7 | Yellow | Blue |
| Methyl red | 4.2–6.2 | 5.0 | Red | Yellow |
| Chlorophenol red | 4.8–6.4 | 6.0 | Yellow | Red |
| Bromothymol blue | 6.0–7.6 | 7.1 | Yellow | Blue |
| Phenol red | 6.4–8.0 | 7.4 | Yellow | Red |
| Cresol purple | 7.4–9.0 | 8.3 | Yellow | Purple |
| Thymol blue | 8.0–9.6 | 8.9 | Yellow | Blue |
| Phenolphthalein | 8.0–9.8 | 9.7 | Colorless | Red |
| Thymolphthalein | 9.3–10.5 | 9.9 | Colorless | Blue |
| Alizarin yellow R | 10.1–12.0 | 11.0 | Yellow | Red |
| Indigo carmine | 11.4–13.0 | 12.2 | Blue | Yellow |

The indicator is generally entrained in the carrier liquid in a concentration of between 0.1% to 10%, preferably 0.5% to 5%, most preferably 1% to 3% based on the total volume of carrier liquid.

It is advantages to provide a stable solution of the indicator in the oil. This is important as a homogenous solution having a consistent initial coloring (or no coloring) is preferred, so as to accentuate the color change which occurs upon reaction. Thus, depending on the nature of the indicator, it may be necessary to add solvents to the carrier liquid composition, or to predissolve the indicator in a suitable solvent which promotes miscibility of the solvent-indicator solution with the carrier liquid.

Preferred solvents are selected from the group consisting of alcohols, aldehydes, ketones, alkoxyalcohols and glycols. Particularly preferred solvents include propan-1-ol, propan-2-ol, butan-1-ol, butan-2-ol, butanone, 2-butoxyethanol, octan-1-ol, octan-2-ol and propane- 1-2-diol. A particularly preferred solvent is propan-2-ol.

In order for an acid/base indicator to work, water must be present. In the present invention the water may be specifically entrained in the liquid carrier, in the solvent, or on the substrate. In practice, it is difficult to exclude water from the blister pack, thus trace amounts are usually present, which precludes the need to specifically add water to the liquid carrier composition. Additionally, upon release of the carrier fluid onto the support, atmospheric water is usually sufficient to enable a significant reaction, thus, a visual change.

Where a solvent is used, the concentration is preferably in the range of 0.5% to 10%, more preferably 1% to 5%, most preferably about 2% by weight of carrier fluid composition.

Mixtures of indicators may also be used in order to provide a range of possible color changes dependent upon the amount and types of indicators mixed.

Where the reagents are those for an acid/base reaction, the substrate is preferably coated or impregnated with an acid or base, capable of reacting with the indicator, present in the blister pack, to produce a color change in the indicator.

Preferred second reagents are selected from organic acids, inorganic acids, organic alkalis and inorganic alkalis.

Preferred acids are selected from sulphuric, hydrochloric, nitric, tartaric, citric, malic, benzoic, sorbic, succinic, formic, acetic and propionic acid.

Preferred alkalis are inorganic carbonates, hydroxides and bicarbonates, in particular, sodium carbonate, sodium hydroxide, sodium bicarbonate, calcium carbonate, calcium hydroxide, calcium bicarbonate, ammonium carbonate, ammonium bicarbonate, ammonium hydroxide, and potassium carbonate, potassium hydroxide, potassium bicarbonate.

It should be understood that the indicator may be present either in the blister pack or on the support, with the second reagent present on or in the alternative feature (the blister pack or substrate) not containing the indicator. However, preferably the blister pack contains the indicator and the support contains the second reagent.

Preferably, the closure comprises a cap and a cover, the sealed enclosure and the indicating means being housed within the cover, the cover being transparent over at least a portion of its surface to offer a view of at least a portion of the indicating means within the cover.

Preferably, the cap is a screw cap fitting or push-fitting for a container. More preferably, the cap and the cover together form a child safety closure.

Preferably, the sealed enclosure is ruptured upon relative movement between the cap and the cover. More preferably, the relative movement is in an axial direction.

Preferably, the closure comprises a number of projections that cause rupturing of the sealed enclosure upon opening of the closure. More preferably, the one or more projections are formed as an integral part of a closure cap. In this example, it is preferred that the indicating means comprises a number of apertures that receive the projections so that upon opening of the closure the projections pierce the bister pack thereby releasing the fluid.

According to a third aspect of the present invention, the combination of a container and a tamper evident closure according to the first aspect of the present invention.

The tamper evident closure of the present invention is primarily intended to be used as an anti-counterfeit measure on a spirit or pharmaceutical bottle. In the preferred embodiment, the closure incorporates a liquid that when brought into contact with a reagent chemical contained in an absorbent pad, effects an irreversible color change. This color change will indicate to a consumer the bottle has been previously opened or tampered with. The design makes it very difficult for a counterfeiter to cover up or eradicate the visible effects. In particular, the only way a counterfeiter could do this would be to put in a replacement blister and an absorbent pad. Filling a blister pack with a liquid is a highly specialist task which makes replication very difficult. The ability to control the color change to complement the branded goods provides a way of building up consumer recognition of the product and thereby establishing confidence in those products that carry the tamper evident closure of the present invention.

BRIEF DESCRIPTION OF THE DRAWINGS

Examples of the present invention will now be described in detail with reference to the accompanying drawings, in which.

DETAILED DESCRIPTION OF SPECIFIC EMBODIMENTS

Figure 1:
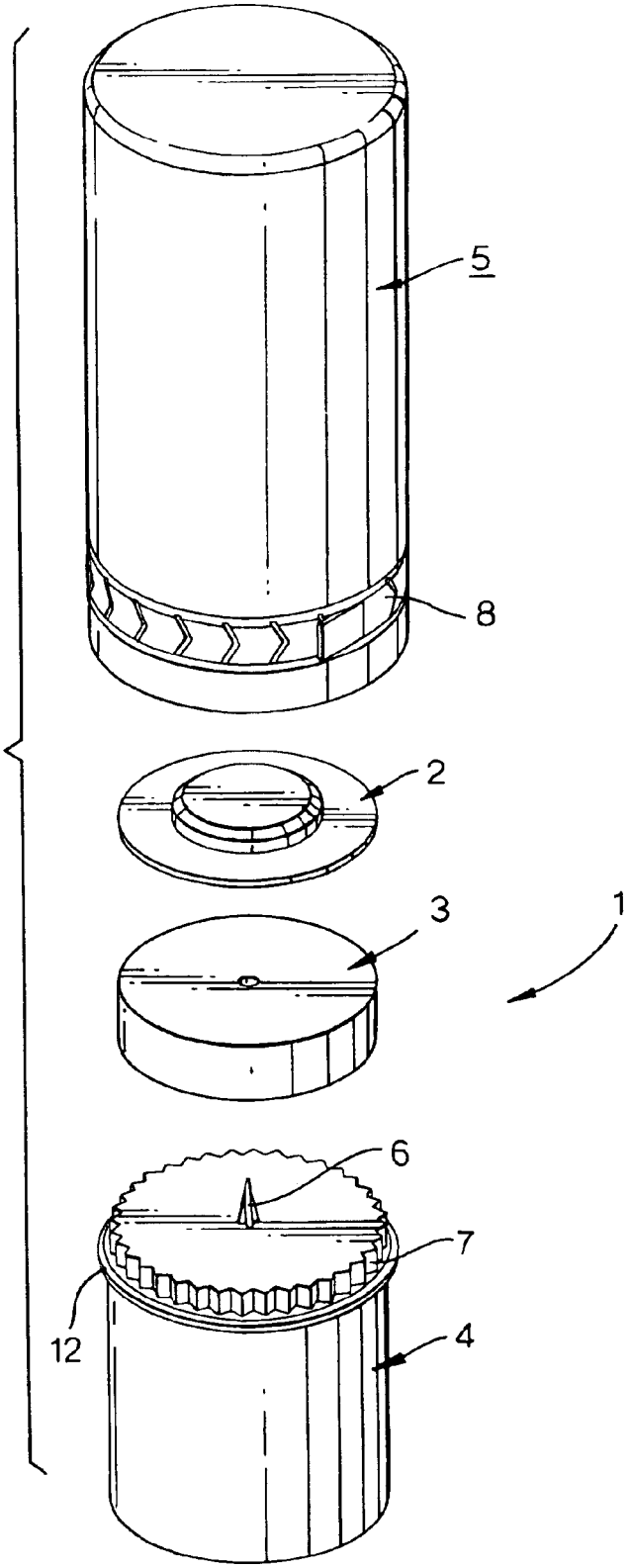
FIG. 1 shows a perspective view of the components of one example of a tamper evident closure in accordance with the present invention.
Figure 2:
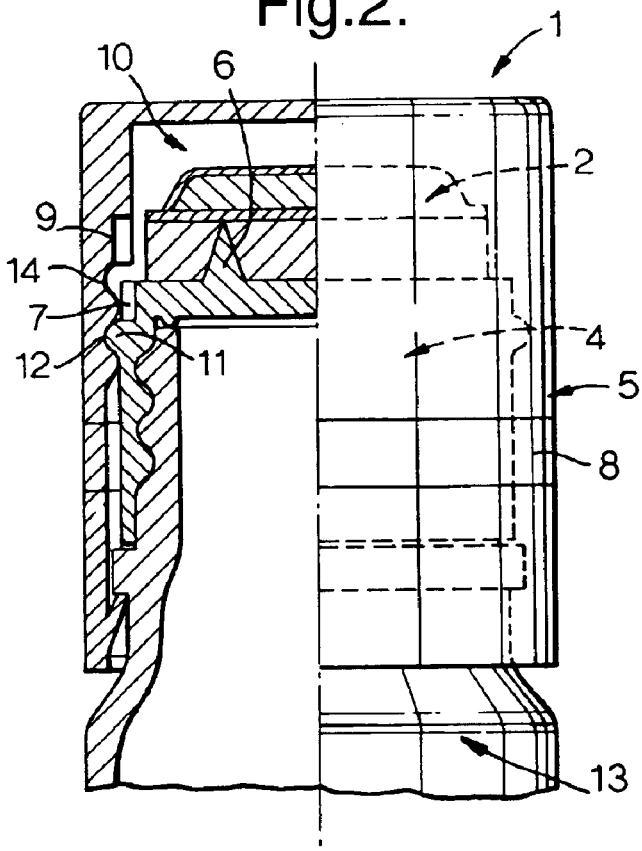
FIGS. 2 and 3 show partial cross-sectional views of an assembled tamper evident closure in an unopened and opened configuration, respectively; and, FIGS. 4 and 5 show partial cross-sectional views of another example of a tamper evident closure in accordance with the present invention in an unopened or opened configuration respectively.
Figure 3:
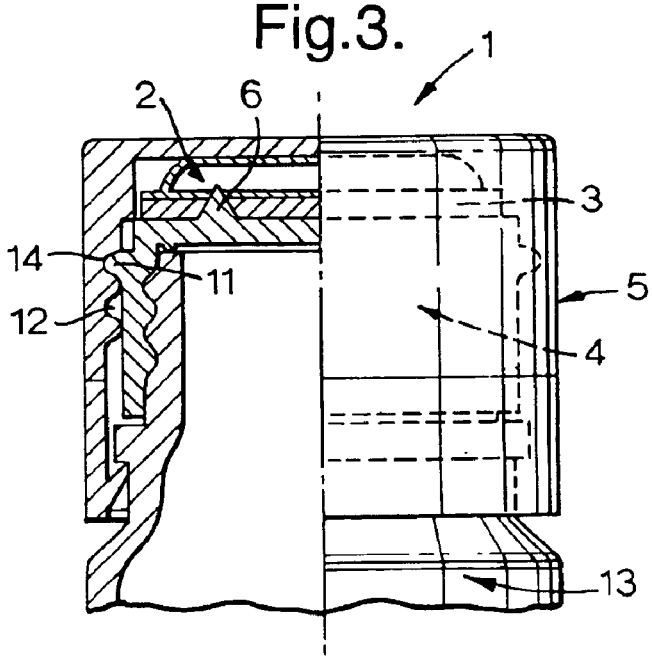

FIGS. 1 to 3 illustrate the components of an example of a tamper evident closure 1 in accordance with the present invention.

The device 1 consists of a thermo-formed blister 2, an absorbent pad 3, a screw cap 4, and a cover 5.

The thermo-formed blister 2 contains a very small volume of liquid paraffin (0.6 ml). The blister consists of a hard outer shell made of a material such as PET and a much thinner membranous seal made of the same material. As will be described below, the membrane is punctured during the opening of the closure 1 to release the liquid content of the blister 2.

The absorbent pad 3 is provided to absorb the contents of the blister 2 on opening of the closure. In this example, the absorbent pad 3 incorporates a reagent that is sensitive to exposure to the liquid within the blister 2 to change color and thereby signal that the closure has been opened. The pad 3 may be made of paper, pulp, cotton, plastics, or other absorbent material. A preferred absorbent pad is one made of cellulose fibres. It is preferred that the absorbent pad has a degree of rigidity to aid the assembly of the closure. It should also be compressible with a degree of resilience to facilitate the initial rupture of the blister 2 and dispersal of the contents thereof.

The screw cap 4 is designed to act as the primary seal of a bottle having a correspondingly threaded neck portion. The screw cap 4 carries one or more projections 6 which cooperate with an aperture 7 formed in the absorbent pad 3 to provide a means of puncturing the blister 2 upon relative axial movement between the screw cap 4 and the cover 5. The screw cap 4 also includes a "male" serrated crown wheel 7, that forms one part of a child-safety type interlock required initially to open the closure.

The cover 5 is transparent over at least a portion of its extent to enable any color change in the absorbent pad 3 to be seen by a consumer. The cover 5 carries a tear strip 8 to stop accidental activation of the tamper evident closure 1. The cover 5 includes a "female" serrated crown wheel 9 that cooperates with the corresponding male crown wheel 7 on the screw cap 4 when the closure 1 is first opened. As will be described in detail below, the cover 5 is also provided with a profiled internal cavity to receive the blister 2, absorbent pad 3 and screw cap 4.

To assemble the tamper evident closure 1, the cover 5 is first placed open side up. The thereto-formed blister 2 is then placed inside with the hard shell down and the membrane facing up. It sits in a cavity 10 within the cover 5 that is profiled to accept the blister. The absorbent pad 3 is then placed inside the cover 5 on top of the blister within the cavity. The screw cap 4 is then located within the cover 5 by pressing a male retaining ring 11 carried by the screw cap 4 into a first female groove 12 provided within the cover 5. Once this retaining ring 11 has been snap fitted into its female counterpart 12 the tamper evident closure 1 is ready for application to a bottle.

The tamper evident closure 1 is fitted to a bottle 13 by screwing the cover 5 in a clockwise direction onto a correspondingly threaded neck. It is important that during this process the downward force used is not enough to active the mechanism. Once the tamper evident closure 1 has been screwed home the device is ready to be used.

In operation, the consumer simply removes the tear strip 8 from the circumference of the cover 5. This allows a relative downward axial movement of the cover 5 to engage the male serrations 7 carried by the screw cap 4 with the female serrations 9 carried by the cover. Simultaneously, the blister 2 is ruptured by the projection 6 carried on the screw cap and the contents of the blister are released onto the absorbent pad 3, thereby effecting a change in color. At this time, the retaining ring 11 carried by the screw cap 4 engages irreversibly with a second female groove 14 carried by the cover 5. This operation is signaled by an audible "click" to provide another signal to the consumer that the closure has operated correctly.

As shown in FIG. 3, once activated, the tamper evident closure is now in a locked state and can be used as a normal screw cap, albeit displaying the irreversible color change through the transparent cover 5.

Figure 4:
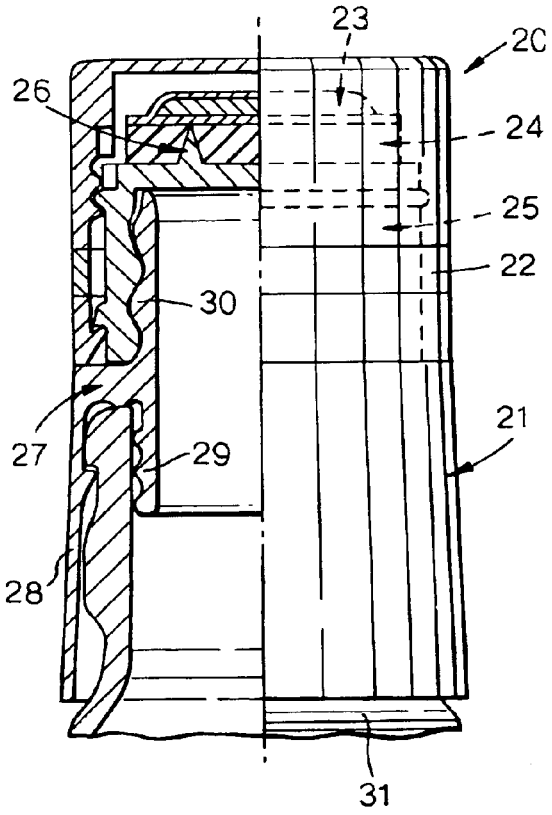
Figure 5:
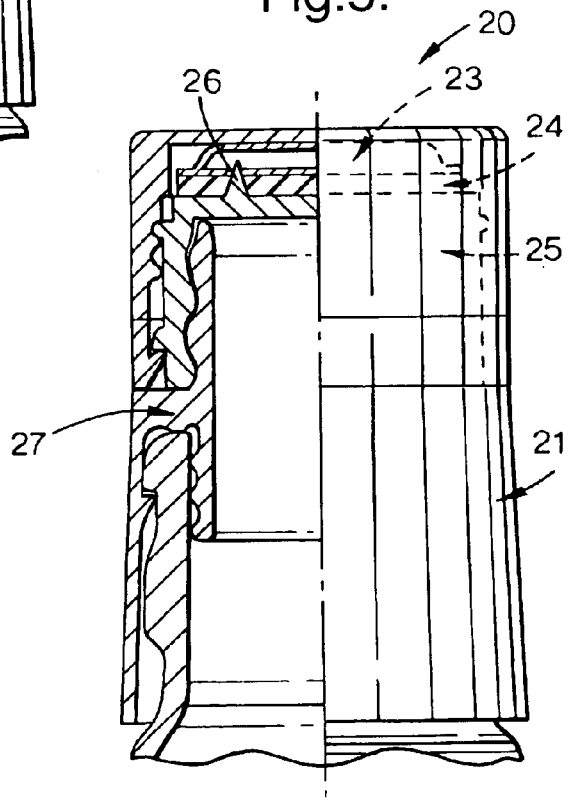

The closure is applicable to most containers. Although the example above includes a conventional screw cap fitting, other fittings are also contemplated. FIGS. 4 and 5 show an example of a closure that uses a push-fitting.

The tamper evident closure 20 shown in FIGS. 4 and 5 comprises a cover 21 having a tear strip 22. The cover 21 houses a blister 23, an absorbent pad 24, and a screw cap 25 having a number of projections 26. In this example, the screw cap 25 is fitted to a complementary threaded push-fitting 27. The push-fitting 27 includes an integral skirt 28, plug 29 and threaded spout section 30.

During assembly, the push-fitting 27 is screwed onto the screw cap 25 and subsequently the entire assembly is snap-fitted onto the neck portion of a bottle 31.

The present invention provides a tamper evident closure in which it is immediately obvious to a consumer as to whether or not the product has been tampered with. In the preferred example, the change in color offers a highly visible indication of this. The visual change is irreversible once the closure has been opened.

Furthermore, the design makes it very difficult for a counterfeiter to cover up or eradicate the visible effects. The only way a counterfeiter could do this would be to put in a replacement blister and an absorbent pad. Filling a blister pack with a liquid is a highly specialist task which makes replication very difficult. Furthermore, it is possible to construct the closure so that it will be broken by any attempt to disassemble it.

The provision of a tear strip makes it difficult to inadvertently trigger the mechanism in a retail environment since the tear strip has first to be removed from the cover. This feature offers another indication that the closure has been tampered with.

It is possible to select the blister liquid and absorbent pad reagent to match or otherwise complement the branded product and so provide another way of building up consumer recognition and confidence in the product.

EXAMPLES

Example 1

Preparation of Substrate Acid Solutions 5.0% solutions of tartaric, malic and citric acids was produced using distilled water. 200 grams of the solid acid was dissolved in 4.0 litres of distilled water and stirred for three minutes. A clear solution was obtained. This solution may then be spray coated onto the support.

Example 2

Preparation of Sodium Hydroxide Solutions

A 5.0% solution of sodium hydroxide was are produced using distilled water. 200 grams of sodium hydroxide was dissolved in 4.0 litres of distilled water and stirred for three minutes. A clear solution was obtained. This solution may then be spray coated onto the support.

Example 3

Preparation of 1.3% methyl red solution is obtained as follows:

(1) 26 ml of the indicator methyl red were added to 1750 ml of light liquid paraffin and stirred well.

(2) The mixture was heated indirectly by using a water bath. The temperature of the water bath did not exceed 100° C. The mixture was left in the water bath for 10 to 12 minutes with continuous stirring.

(3) The mixture was removed from the water bath and left to cool down to room temperature. A clear yellow solution was obtained by the end of this step. This indicator works on paper pads which have been treated with citric, tartaric or malic acids and changes color from yellow to red.

Example 4

Preparation of 2.0% bromocresol Green in a stable solvent combination is obtained as follows:

(1) 35 ml (2%) of propan-2-of was added to 1750 ml of silicone oil (20 $mm^2/s$ and stirred well. The solution is left for 3 minutes and a clear colorless solution was obtained.

(2) 35 ml of bromocresol green was added to the mixture and stirred.

(3) The mixture is indirectly heated in a water bath. The temperature of the water bath did not exceed 100° C. The mixture was left in the water bath for 10 to 12 minutes with continuous stirring. This enhances the indicator solubility.

(4) The mixture was removed from the water bath and left to cool down to room temperature. A clear yellow solution was obtained by the end of this step.

This indicator works on paper pads which have been treated with sodium hydroxide and changes color from yellow to blue.

Example 5

Preparation of a mixture of two pH indicators

A mixture of bromocresol green in silicone oil 20 $mm^2/s$ and methyl red in silicone oil 20 $mm^2/s$ at the ratio 1:1 was produced as follows:

5*a*. Preparation of bromocresol green combination:

(1) 17.5 ml of propan-2-of were added to 900 ml of silicone oil 20 $mm^2/s$ and stirred well. The mixture was stirred for 3 minutes. A clear colorless solution was obtained.

(2) 17.5 ml of bromocresol green were added to the mixture obtained from step 1 and stirred well.

(3) The temperature of the water bath did not exceed 100° C. The mixture was left in the water bath for 10 to 12 minutes with continuous stirring. This enhances the indicator solubility.

(4) The mixture was removed from the water bath and left to cool down to room temperature. A clear yellow solution was obtained by the end of this step.

5b. Preparation of methyl red combination:

(1) 13.5 ml of methyl red was added to 900 ml of silicone oil 20 $mm^2/s$ and stirred well.

(2) The mixture was heated indirectly using a water bath and keep stirring. The temperature of the water bath did not exceed 100° C.

(3) The mixture was taken out of the water bath and left to cool down to room temperature. A clear bright yellow solution should be obtained by the end of this step.

The two combinations of indicators are then mixed together in equal volume ratios and stirred for at least three minutes. This produces a final combination of a golden yellow color. This combination works on paper pads that have been pretreated with sodium hydroxide and changes color to green.

Example 6

Preparation of mixture of phenolphthalein and bromocresol green in a 3:1 ratio was obtained as follows:

(1) 27 ml of octan-1-of were added to 1300 ml of silicone oil 20 $mm^2/s$ and stirred well. The mixture was stirred for 3 minutes. A clear colorless solution was obtained.

(2) 27 ml of phenolphthalein was added to the mixture of silicone oil and alcohol and stirred well.

(3) The temperature of the water bath did not exceed 100° C. The mixture was left in the water bath for 10 to 12 minutes with continuous stirring. This enhances the indicator solubility.

(4) The mixture was removed from the water bath and left to cool down to room temperature. A colorless solution with white clouds should be obtained by the end of this step.

The bromocresol solution was prepared as per Example 4, except that 9 ml of bromocresol green was dissolved in 450 ml of silicone oil 20 $mm^2/s$. The solutions were then mixed and stirred. The final solution color was faint yellow. This combination works on paper pads that have been pre-treated with sodium hydroxide and changes color to light mauve.

What is claimed is:

1. A tamper evident closure comprising:

a. a blister pack disposed within a housing, the blister pack containing a first reagent visible prior to first opening of the closure; and b. a substrate disposed within the housing, the substrate containing a second reagent, such that a first opening of the closure ruptures the blister pack thereby exposing the first reagent to the second reagent and effects a reaction causing a visual change that signals that the closure has been opened.

2. A closure according to claim 1, wherein the substrate changes color in response to exposure to the first reagent.

3. A closure according to claim 2, wherein the substrate carries a latent image that is developed upon exposure to the first reagent.

4. A closure according to claim 1, wherein the substrate carries a latent image that is developed upon exposure to the first reagent.

5. A closure according to claim 1, further comprising a plurality of projections that cause rupturing of the blister pack upon first opening of the closure.

6. A closure according to claim 1, wherein the closure further comprises a cap and a cover, the cover characterized by an outer surface, the blister pack and the substrate disposed within the cover, the cover being transparent over at least a portion of its outer surface in such a manner as to offer a view of at least a portion of the substrate and/or the blister pack within the cover.

7. A closure according to claim 6, wherein the cap is a fitting for a container.

8. A closure according to claim 7, wherein the blister pack is such as to be ruptured upon relative movement between the cap and the cover.

9. A closure according to claim 8, wherein the relative movement is in an axial direction.

10. A closure according to claim 7, wherein the cap and the cover together form a child-safety closure.

11. A closure according to claim 10, wherein the blister pack is such as to be ruptured upon relative movement between the cap and the cover.

12. A closure according to claim 11, wherein the relative movement is in an axial direction.

13. A closure according to claim 6, further comprising a plurality of projections that cause rupturing of the blister pack upon first opening of the closure.

14. A closure according to claim 6, further comprising a plurality of projections formed as an integral part of the cap.

15. A closure according to claim 1, wherein the first reagent is dissolved, dispersed or suspended in a carrier fluid.

16. A closure according to claim 15, wherein the carrier fluid is an oil.

17. A closure according to claim 16, wherein the oil includes at least one of a mineral oil and a synthetic oil.

18. A closure according to claim 15, wherein the carrier fluid is selected from the group consisting of silicone, fluorinated silicone, petroleum, glycol, ester, fluorocarbon and perfluorocarbon oils.

19. A closure according to claim 15, wherein the carrier fluid is characterized by a kinematic viscosity in the range of 0.000001 $m^2/s$ to 0.0001 $m^2/s$.

20. A closure according to claim 15, wherein the carrier fluid is characterized by a kinematic viscosity in the range of 0.00001 $m^2/s$ to 0.00003 $m^2/s$.

21. A closure according to claim 1, wherein the substrate is pre-treated with the second reagent by impregnation or coating with the second reagent.

22. A closure according to claim 1, wherein the substrate is spray coated with a solution of the second reagent.

23. A closure according to claim 1, wherein the second reagent is selected from the group of organic acids, inorganic acids, organic alkalis and inorganic alkalis.

24. A closure according to claim 1, wherein the second reagent is an acid selected from the group consisting of sulphuric, hydrochloric, nitric, tartaric, citric, malic, benzoic, sorbic, succinic, formic, acetic and propionic acid.

25. A closure according to claim 1, wherein the second reagent is an alkali selected from the group consisting of sodium carbonate, sodium hydroxide, sodium bicarbonate, calcium carbonate, calcium hydroxide, calcium bicarbonate, ammonium carbonate, ammonium bicarbonate, ammonium hydroxide, potassium carbonate, potassium hydroxide and potassium bicarbonate.

26. A closure according to claim 1, wherein the first reagent is a pH indicator selected from the group consisting of methyl violet, thymol blue, methyl yellow, methyl orange, bromocresol green, methyl red, chlorophenol red, bromothymol blue, phenol red, cresol purple, phenolphthalein, thymolphthalein, alizarin yellow R and indigo carmine.

27. A closure according to claim 15, wherein the first reagent is entrained in the carrier fluid in a concentration of between 0.1% and 10% by volume.

28. A closure according to claim 15, wherein the first reagent is entrained in the carrier fluid in a concentration of between 0.5% and 5% by volume.

29. A closure according to claim 15, wherein the first reagent is entrained in the carrier fluid in a concentration of between 1% to 3% by volume.

30. A closure according to claim 1, wherein the blister pack contains a solvent selected from the group consisting of alcohols, aldehydes, ketones, alkoxyalcoholsandglycols.

31. A tamper evident closure according to claim 1, further comprising a container wherein opening of the container ruptures the blister pack.

* * * * *